US006715749B2

(12) United States Patent
Trovinger

(10) Patent No.: US 6,715,749 B2
(45) Date of Patent: Apr. 6, 2004

(54) BOOKLET MAKER AND METHOD OF MANUFACTURING A BOOKLET MAKER

(75) Inventor: Steven W. Trovinger, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/231,127

(22) Filed: Aug. 30, 2002

(65) Prior Publication Data

US 2004/0041326 A1 Mar. 4, 2004

(51) Int. Cl.[7] ..... B42C 19/00

(52) U.S. Cl. ..... 270/58.07; 270/52.17; 270/32; 83/934; 412/16; 412/18; 493/444; 493/446; 493/475; 493/356

(58) Field of Search ..... 270/52.17, 32, 270/58.07; 83/934; 412/9, 16, 18; 493/444, 478, 475, 476, 445, 356, 357, 309, 360, 446

(56) References Cited

U.S. PATENT DOCUMENTS

| | | | | |
|---|---|---|---|---|
| 3,627,305 | A | * 12/1971 | Heigl et al. | 493/342 |
| 4,053,150 | A | 10/1977 | Lane | |
| 4,289,494 | A | * 9/1981 | Bolza-Schunemann | 493/405 |
| 4,595,187 | A | * 6/1986 | Bober | 270/37 |
| 4,891,681 | A | * 1/1990 | Fiske et al. | 399/385 |
| 5,087,163 | A | 2/1992 | Erdbories et al. | |
| 5,346,350 | A | 9/1994 | Luhman et al. | |
| 5,377,965 | A | * 1/1995 | Mandel et al. | 270/37 |
| 5,452,920 | A | 9/1995 | Parker | |
| 5,461,469 | A | * 10/1995 | Farrell et al. | 399/407 |
| 5,465,213 | A | 11/1995 | Ross | |
| 5,501,442 | A | * 3/1996 | Mandel | 270/58.07 |
| 5,876,027 | A | * 3/1999 | Fukui et al. | 270/51 |
| 6,059,711 | A | * 5/2000 | Wang | 493/360 |
| 6,193,458 | B1 | 2/2001 | Marsh | |
| 6,363,851 | B1 | 4/2002 | Gerhard et al. | |
| 6,460,843 | B1 | * 10/2002 | Dim et al. | 270/58.07 |
| 6,550,756 | B2 | 4/2003 | Trovinger | |
| 6,554,267 | B2 | 4/2003 | Trovinger | |
| 2002/0140153 | A1 | 10/2002 | Trovinger et al. | |
| 2002/0141849 | A1 | 10/2002 | Trovinger et al. | |
| 2002/0146302 | A1 | 10/2002 | Trovinger | |
| 2002/0168247 | A1 | 11/2002 | Trovinger et al. | |
| 2003/0069117 | A1 | 4/2003 | Trovinger et al. | |
| 2003/0069118 | A1 | 4/2003 | Trovinger et al. | |
| 2003/0069119 | A1 | 4/2003 | Trovinger et al. | |
| 2003/0069121 | A1 | 4/2003 | Trovinger et al. | |
| 2003/0161704 | | 8/2003 | Trovinger | |
| 2003/0162644 | | 8/2003 | Trovinger | |

FOREIGN PATENT DOCUMENTS

| | | | |
|---|---|---|---|
| WO | WO 00/18583 | | 4/2000 |
| WO | WO 00/18583 | * | 6/2000 |

OTHER PUBLICATIONS

Steven W. Trovinger et al., U.S. patent application No. 09/831,768 filed May 14, 2001, for "Method and Apparatus for Making Booklets".

Steven W. Trovinger et al., U.S. patent application No. 09/970,730 filed Oct. 5, 2001, for "Sheet Folding Apparatus".

Steven W. Trovinger, U.S. patent application No. 10/242,436 filed Sep. 13, 2002, for "Apparatus for Stacking Folded Paper Sheets".

Steven W. Trovinger, U.S. patent application No. 10/259,458 filed Sep. 30, 2002, for "Method and Apparatus for Sheet Folding".

* cited by examiner

*Primary Examiner*—Patrick Mackey

(57) ABSTRACT

A sheet wise booklet maker includes adjustable elements to allow adjustment of the parallelism of the booklet maker elements to produce quality booklets. The booklet maker includes a sheet trimmer, a folding apparatus, and a paper drive. Orientations of at least two of the sheet trimmer, folding apparatus, and paper drive are adjustable to achieve parallelism between the sheet trimmer, folding apparatus, and paper drive.

21 Claims, 3 Drawing Sheets

BOOKLET MAKER AND METHOD OF MANUFACTURING A BOOKLET MAKER

BACKGROUND OF THE INVENTION

1. Field of the Invention

The present invention generally relates to a booklet maker and a method of manufacturing a booklet maker and, more particularly, to a booklet maker and method to ensure parallelism between booklet maker components for production of high quality booklets.

2. Background Information

A saddle stitched booklet is a booklet which is printed on both sides of the sheets of paper, folded, and stapled or otherwise bound to create a booklet. Saddle stitched booklets can contain any number of pages (e.g., 100 pages; that is 100 booklet pages produced from 25 sheets of paper printed on both sides and folded).

Saddle stitched booklets can be formed by processing the entire booklet at once. A stack of printed sheets can be arranged and squared off and then stapled. After the sheets are stapled, the entire stack is folded. Once folded, the free ends of the sheets form two beveled edges because the outer sheets wrap around the inner sheets. The entire booklet is then trimmed to even out the edges. A heavy duty folding apparatus and a heavy duty cutting apparatus can be used to perform the folding and trimming operations in these machines since many sheets are folded and cut at once. These machines can be bulky, expensive, and involve a skilled operator. Thus, booklet making machines are found in commercial document production facilities.

A system for finishing printed sheets into booklets in a sheetwise manner is described in PCT Document No. WO 00/18583 (referred to as "the Trovinger PCT"), hereby incorporated by reference in its entirety. The system of the Trovinger PCT trims and folds sheets in a sheetwise manner (sheet-by-sheet). Specifically, each sheet is trimmed to a width which is determined based on its location in the booklet with the inside sheets having a smaller width than the outside sheets. The trimmed sheets are then folded one at a time at a precise location. The trimmed and folded sheets are then collected into a stack and stapled or otherwise bound into a booklet. The booklet maker described in the Trovinger PCT is compact and inexpensive and thus, is suitable for use in a home or small office.

In a sheetwise booklet maker, alignment of the trimming apparatus, the folding apparatus, and the sheet feeding apparatus in the booklet maker is used to produce quality booklets with properly aligned pages. Alignment of the parts of the booklet maker may be achieved by the use of parts with tight tolerances. However, the tighter the tolerances for the booklet maker parts, the more expensive the parts are to manufacture.

SUMMARY OF THE INVENTION

The present invention is directed to a sheetwise booklet maker and method of manufacturing a booklet maker in which orientations of the longitudinal axes of elements of the booklet maker are adjusted and locked in place to achieve parallelism of the elements.

According to an exemplary embodiment of the present invention, a sheetwise booklet maker comprises a sheet trimmer including a cutting blade having a longitudinal axis, a folding apparatus including a fold blade having a longitudinal axis, and a paper drive positioned to transport individual sheets to the sheet trimmer and the folding apparatus, the paper drive having a longitudinal axis. Orientations of at least two of the cutting blade longitudinal axis, the fold blade longitudinal axis, and the paper drive longitudinal axis are adjustable to achieve parallelism between the sheet trimmer, folding apparatus, and paper drive.

Exemplary embodiments are also directed to a sheetwise booklet maker for trimming and folding individual sheets of material and binding the individual sheets together in a booklet which comprises trim means for trimming edges of individual sheets, the trim means having a longitudinal axis, fold means for folding the individual sheets, the fold means having a longitudinal axis, transport means for transporting the individual sheets to the trimming and folding means, the transport means having a longitudinal axis, and means to adjust orientations of the longitudinal axes of at least two of the trim means, fold means, and transport means to achieve parallelism between the trim means, fold means, and transport means.

The present invention is also related to an exemplary method of manufacturing a booklet maker which comprises assembling a booklet maker including a sheet trimmer, a folding apparatus, and a paper drive positioned to transport individual sheets to the sheet trimmer and the folding apparatus; adjusting the orientations of longitudinal axes of at least two of the sheet trimmer, the folding apparatus, and the paper drive to achieve parallelism between the sheet trimmer, folding apparatus, and paper drive; and locking the at least two of the sheet trimmer, folding apparatus, and paper drive in the parallel arrangement.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE PREFERRED EMBODIMENTS

Figure 1:
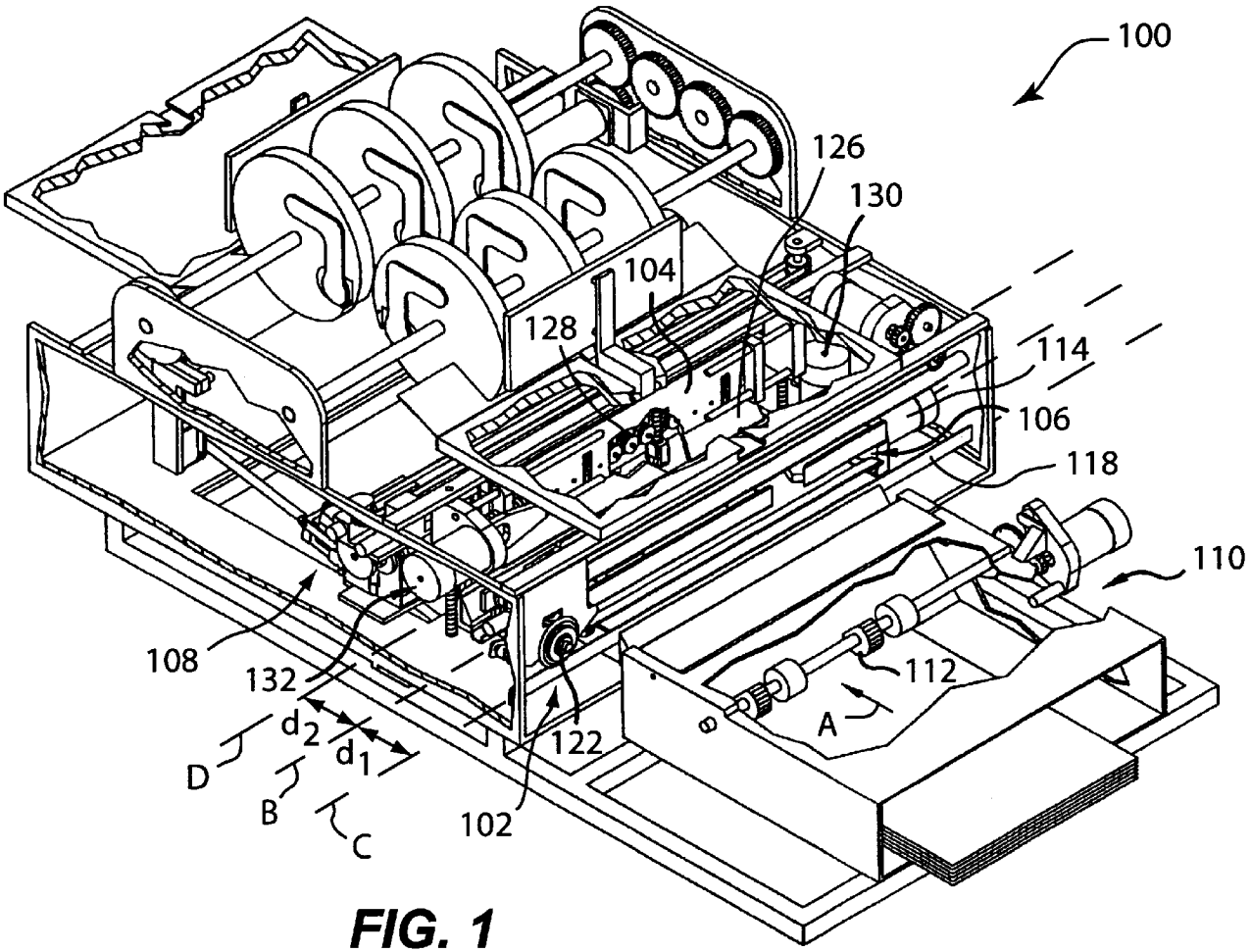
FIG. 1 is a perspective view of a booklet maker, partially cut away, illustrating the input of paper sheets in the near field.

FIG. 1 illustrates a sheetwise booklet maker 100 according to an exemplary embodiment of the present invention. The sheetwise booklet maker 100 is a low cost, off line booklet maker which can be used in conjunction with desktop laser printers, ink-jet printers, high speed printers, copying machines, or the like to assemble and bind sheets into a booklet. The booklet maker 100 operates in a sheetwise manner which allows the use of lower actuation forces than conventional booklet makers which perform trimming, punching, and other operations on a completed booklet.

The sheetwise booklet maker 100 includes adjustable elements for providing alignment between the various parts of the booklet maker to produce high quality booklets with aligned pages. Specifically, the booklet maker 100 includes a sheet trimmer 102, a folding apparatus 104, and a paper drive 106 which can be adjusted to be parallel to ensure proper alignment of the sheets and fold in the final booklet. In order to produce a booklet maker 100 in which the folding apparatus 104, the paper drive 106, and the sheet trimmer 102 are easily aligned during manufacture of the booklet maker without the need for expensive high tolerance parts, at least two of the folding apparatus 104, the paper drive 106, and the sheet trimmer 102 are adjustable.

One example of a booklet maker 100, illustrated in FIG. 1, includes an automatic sheet feeder 110 which separates the stack of printed sheets and feeds one sheet at a time into a paper path of the booklet maker. Pick tires 112 in the sheet feeder 110 deliver the sheets to the paper drive 106, which may be a precision paper drive assembly, as shown, which moves the sheets forward and backward in the paper path direction A with precision within the booklet maker so that the sheets may be measured for length, cut, and folded. The paper drive 106 moves the sheets one at a time and includes one or more drive wheels (not shown in FIG. 1) mounted on a shaft and driven by a drive motor 114. The paper drive 106 has a paper drive axis B.

The sheet trimmer 102 trims each sheet to a predetermined length in the booklet maker. The predetermined length of each sheet is determined by the finished size of the booklet and the position of the sheet in the booklet. The sheet trimmer 102 includes a cutting blade 118 extending across the paper path. The cutting blade 118 has a longitudinal axis C. A cutter assembly 122 including a cutting wheel transversely moves across the paper path along the cutting blade 118 cleanly cutting off a strip of the sheet in one pass. The amount trimmed is determined by a sheet cutting schedule provided in the control electronics of the booklet maker. The amount trimmed is controlled by precisely moving the sheet with the paper drive 106. The cutting blade 118 is a flat straight edge with an axis C that is adjustable to be parallel with the axis B of the paper drive rollers. An adjustment mechanism for achieving parallelism of the cutting blade 118 and the paper drive 106 will be described in further detail below with reference to FIGS. 4A and 4B.

The sheet trimmer 102 illustrated in the figures includes a cutting wheel blade which traverses along the cutting blade 118. However, alternative trimming apparatus may also be used, such as a pair of cutting wheel blades movably mounted on a track. The alternative trimming apparatus would include an adjustment mechanism for achieving parallelism.

The folding apparatus 104 forms a sharp fold in each sheet by forcing the sheet down over a fold blade 126 with a folder assembly 128. Each sheet is precisely positioned over the fold blade 126 by the paper drive 106 to place the fold in a desired location on the sheet. The folder assembly 128 shown in FIG. 1 includes a vertical drive motor 130 which translates the folder assembly upward and downward with respect to the paper path. The folder assembly 128 also includes a horizontal drive motor 132 which translates folding rollers along the fold blade 126. The folder assembly 128 shown in FIG. 1 is one of the folding assemblies which may be used, however, other folding assemblies may also be used including folding flaps, folding fingers, other arrangements of folding rollers, and combinations thereof.

The fold blade 126 has a longitudinal axis D having an orientation which is adjusted to be parallel to the paper drive axis B and the cutting blade axis C by an adjustment mechanism which may be adjusted during manufacture of the booklet maker.

The paper drive 106 precisely positions the sheets so that the location where a fold is desired can be placed directly over the fold blade 126. The folder assembly 128 then proceeds to make the fold in the sheet by pressing the sheet down over the fold blade 126 and rolling along the fold blade. Once the fold is fully formed, the fold assembly 128 is translated upward and out of the paper path so that the sheet may be ejected from the folding apparatus and passed on to a collection and stapling apparatus for final assembly of the booklet.

The fold blade 126 is a straight edge extending along the longitudinal axis D that is parallel with the axis B of the paper drive rollers. An adjustment mechanism for achieving parallelism of the fold blade 126, the paper drive 106, and the cutting blade 118 will be described in further detail below with reference to FIGS. 4A and 4B.

After folding of the sheets, the sheets are delivered to a collection and stapling apparatus 108. The collection and stapling apparatus may include a saddle and a stapler. The sheets are collected with their folds on the saddle and stapled by moving the saddle and/or stapler toward one another.

Figure 3:
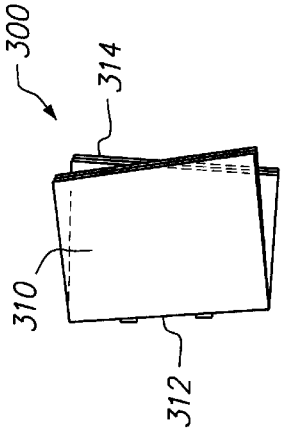
FIG. 3 is a top view of a stapled stack of sheets formed when a sheet folding apparatus is non parallel to a sheet trimmer and paper drive.
Figure 2:
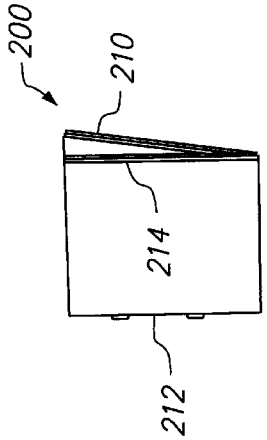
FIG. 2 is a top view of a stapled stack of sheets formed when a sheet trimmer is non parallel to a sheet folding apparatus and paper drive.

FIGS. 2 and 3 illustrate booklets which have been formed by a booklet maker in which the fold blade 126, the paper drive 106, and the cutting blade 118 were not properly oriented in a parallel arrangement. In FIG. 2, a booklet 200 has been formed in a booklet maker in which the sheet trimmer 102 is misaligned with the paper drive 106 and the folding apparatus 104. In FIG. 2, the trailing edges 210 of the sheets are skewed with respect to the fold 212 and the leading edges 214.

In FIG. 3, a booklet 300 has been formed in a booklet maker in which the folding apparatus 104 is misaligned with the sheet trimmer 102 and paper drive 106. In the booklet 300, the front half 310 and the back half 314 of the booklet are misaligned with respect to the fold 312. The misaligned booklets 200, 300 of FIGS. 2 and 3 are merely examples of the types of misalignments which may occur when the fold blade 126, the paper drive 106, and the cutting blade 118 are misaligned.

Figure 4A:
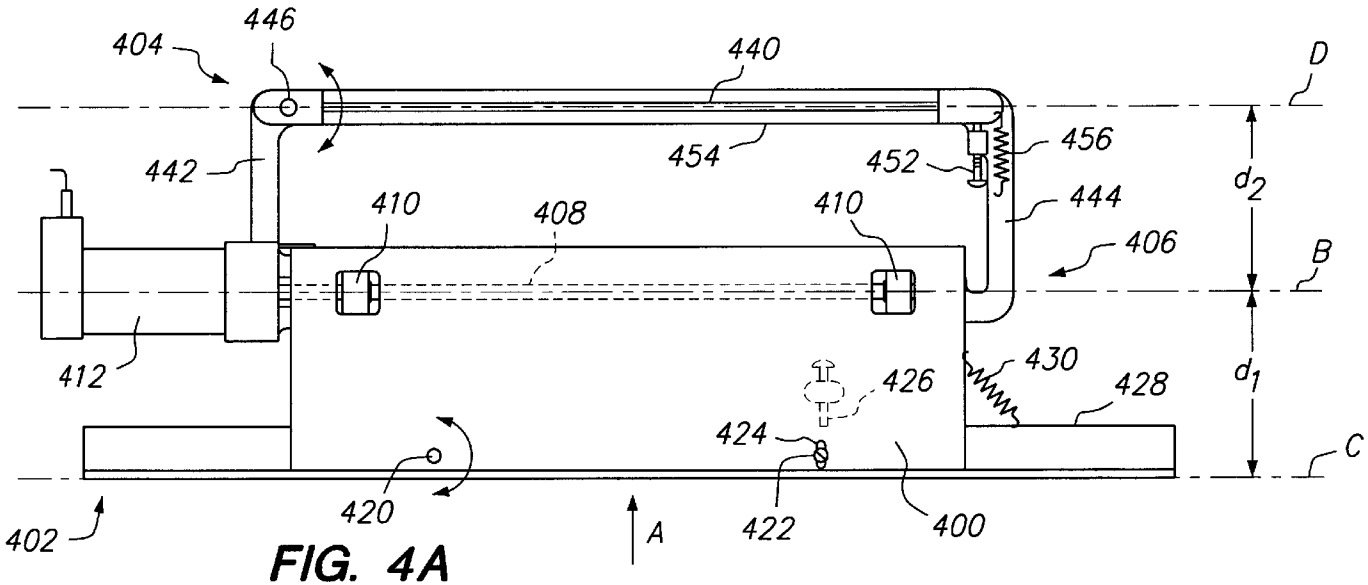
FIG. 4A is a top plan view of a portion of a booklet maker with an adjustable sheet trimmer and an adjustable folding apparatus.
Figure 4B:
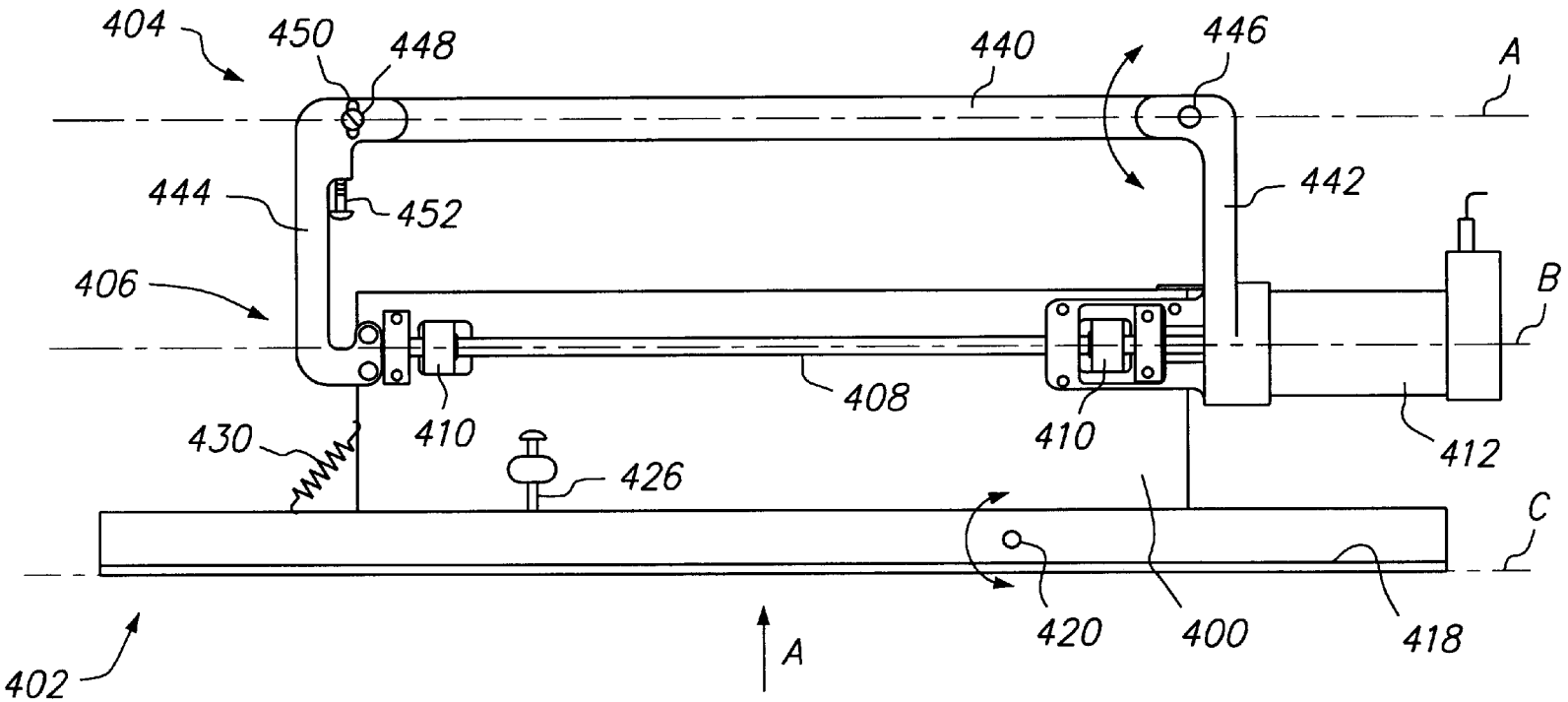
FIG. 4B is a bottom view of the booklet maker of FIG. 4A.

FIGS. 4A and 4B illustrate a top view and bottom view, respectively, of a portion of a booklet maker with adjustment mechanisms for adjusting the orientations of the longitudinal axes of the fold blade and cutting blade with respect to the paper drive. However, any two or more of the cutting blade, paper drive, and fold blade may be adjustable to achieve the desired parallelism.

In FIGS. 4A and 4B illustrate a portion of a booklet maker including a booklet maker body 400 having a sheet trimmer 402 and a folding apparatus 404 pivotally attached to the booklet maker body and a paper drive 406 fixed to the booklet maker body. The paper drive 406 includes a drive shaft 408, drive rollers 410, and a motor 412. Although the paper drive 406 is fixed in the illustrated embodiment, the paper drive may also be movable with respect to the booklet maker body 400.

The portion of the booklet maker illustrated in FIGS. 4A and 4B forms a trimming and folding system which may be movable with respect to a remainder of the booklet. Precise parallel alignment can be provided between cutting and folding portions of the booklet maker and the associated precision paper drive(s). Precise alignment need not be provided for the paper collection and folding systems and the automatic sheet feeder.

The cutting blade 418 of the sheet trimmer 402 is attached to the body 400 by a pivot 420 and a locking screw 422. The locking screw 422 is threaded into the cutting blade 418 and is movable in a slot 424 in the body 400. Precise adjustment of the orientation of the cutting blade 418 is performed by loosening the locking screw 422 and rotating an adjustment screw 426 in contact with an edge 428 of the cutting blade 418. The cutting blade 418 can be biased by a spring 430 against the adjustment screw 426. Once a desired orientation of the cutting blade 418 is achieved and measured by known measurement systems, the cutting blade 418 is locked in the desired orientation by the locking screw 422. Measuring systems for precisely reading parallelism can be laser measurement devices or LVDT displacement measuring transducers.

The fold blade 440 of the folding apparatus 404 is attached to the body 400 by two arms 442, 444 on the body. The fold blade 440 is pivotally attached to the arm 442 by a pivot 446 and to the arm 444 by a locking screw 448. The locking screw 448, shown in FIG. 4B, is threaded into the fold blade 440 and is movable in a slot 450 in the arm 444. Precise adjustment of the orientation of the fold blade 440 is performed by loosening the locking screw 448 and rotating an adjustment screw 452 in contact with an edge 454 of the fold blade 440. The fold blade 440 is preferably biased by a spring 456, shown in FIG. 4A, against the adjustment screw 452. Once a desired orientation of the fold blade 440 is achieved and measured by known measurement systems, the fold blade is locked in the desired orientation by the locking screw 448.

The adjustment mechanisms are tuned so that each rotation of the adjustment screws 426, 452 move the cutting blade 418 or fold blade 440 a defined distance or defined angle. Once parallelism has been achieved and the cutting blade 418 and fold blade 440 have been locked in place, a precision measurement is made of the final adjusted distance between the cutting blade and the fold blade. This distance is input into the control electronics of the booklet maker to allow the booklet maker to precisely move the sheets from the sheet trimmer to the folding apparatus.

The adjustment mechanisms shown in FIGS. 4A and 4B are merely one example of an adjustment mechanism for providing parallelism of the fold blade, the paper drive, and the cutting blade. Other adjustment mechanisms may also be used.

The adjustment of the parallelism of the fold blade, the paper drive, and the cutting blade can be performed on the assembly line and further adjustment is not necessary. However, adjustment may also be performed by a service technician at a later date.

A method of manufacturing a booklet maker according to the present invention, includes the steps of assembling the booklet maker including the sheet trimmer, folding apparatus, and paper drive, and adjusting at least two of the sheet trimmer, folding apparatus, and paper drive longitudinal axes to achieve parallelism between the sheet trimmer, folding apparatus, and paper drive. The adjusted elements are locked in place, such as by the locking screws 422, 448. After locking of the elements in place, a distance d, between the sheet trimmer 402 and paper drive 406; and a distance $d_2$ between the folding apparatus 404 and the paper drive 406 are measured and input into the control electronics in the processor of the booklet maker.

The present invention has been described with respect to adjustment of the sheet trimmer, folding apparatus, and/or the paper drive. However, other systems of the booklet maker, when present, may also be adjusted to achieve parallelism. Examples of other systems which may also be adjusted, include one or more of a second transverse cutter, a side cutter arranged perpendicular to the paper path, a perforation wheel, a tab punch, hole punch, and other punches.

It will be appreciated by those skilled in the art that the present invention can be embodied in other specific forms without departing from the spirit or essential characteristics thereof. The presently disclosed embodiments are therefore considered in all respects illustrative and not restricted. The scope of the invention is indicated by the appended claims rather than the foregoing description and all changes that come within the meaning and range and equivalence thereof are intended to be embraced within.

What is claimed is:

1. A sheetwise booklet maker comprising:

a sheet trimmer including a cutting blade having a longitudinal axis;

a folding apparatus including a fold blade having a longitudinal axis;

a paper drive positioned to transport individual sheets to the sheet trimmer and the folding apparatus, the paper drive having a longitudinal axis; and an adjusting mechanism for adjusting the orientations of at least two of the cutting blade longitudinal axis, the fold blade longitudinal axis, and the paper drive longitudinal axis to achieve parallelism between the sheet trimmer, folding apparatus, and paper drive.

2. The booklet maker of claim 1, comprising a booklet maker body, wherein the sheet trimmer, the folding apparatus, and the paper drive are mounted on the booklet maker body.

3. A sheetwise booklet maker comprising:

a sheet trimmer including a cutting blade having a longitudinal axis;

a folding apparatus including a fold blade having a longitudinal axis;

a paper drive positioned to transport individual sheets to the sheet trimmer and the folding apparatus, the paper drive having a longitudinal axis; and a booklet maker body, wherein the sheet trimmer, the folding apparatus, and the paper drive are mounted on the booklet maker body, wherein the orientations of at least two of the cutting blade longitudinal axis, the fold blade longitudinal axis, and the paper drive longitudinal axis are adjustable to achieve parallelism between the sheet trimmer, folding apparatus, and paper drive, and wherein the cutting blade is pivotally attached to the booklet maker body to allow adjustment of the orientation of the cutting blade longitudinal axis and a cutting blade lock is arranged to lock the cutting blade in a desired orientation on the booklet maker body.

4. A sheetwise booklet maker comprising:

a sheet trimmer including a cutting blade having a longitudinal axis;

a folding apparatus including a fold blade having a longitudinal axis;

a paper drive positioned to transport individual sheets to the sheet trimmer and the folding apparatus, the paper drive having a longitudinal axis; and a booklet maker body, wherein the sheet trimmer, the folding apparatus, and the paper drive are mounted on the booklet maker body, wherein the orientations of at least two of the cutting blade longitudinal axis, the fold blade longitudinal axis, and the paper drive longitudinal axis are adjustable to achieve parallelism between the sheet trimmer, folding apparatus, and paper drive, and wherein the fold blade is pivotally attached to the booklet maker body to allow adjustment of the orientation of the fold blade longitudinal axis and a fold blade lock is arranged to lock the fold blade in a desired orientation on the booklet maker body.

5. A sheetwise booklet maker comprising:

a sheet trimmer including a cutting blade having a longitudinal axis;

a folding apparatus including a fold blade having a longitudinal axis;

a paper drive positioned to transport individual sheets to the sheet trimmer and the folding apparatus, the paper drive having a longitudinal axis; and a booklet maker body, wherein the sheet trimmer, the folding apparatus, and the paper drive are mounted on the booklet maker body, wherein the orientations of at least two of the cutting blade longitudinal axis, the fold blade longitudinal axis, and the paper drive longitudinal axis are adjustable to achieve parallelism between the sheet trimmer, folding apparatus, and paper drive, and wherein the paper drive is pivotally attached to the booklet maker body to allow adjustment of the orientation of the paper drive longitudinal axis and a paper drive lock is arranged to lock the paper drive in a desired orientation on the booklet maker body.

6. A sheetwise booklet maker comprising:

a sheet trimmer including a cutting blade having a longitudinal axis;

a folding apparatus including a fold blade having a longitudinal axis;

a paper drive positioned to transport individual sheets to the sheet trimmer and the folding apparatus, the paper drive having a longitudinal axis; and a booklet maker body, wherein the sheet trimmer, the folding apparatus, and the paper drive are mounted on the booklet maker body, wherein the orientations of at least two of the cutting blade longitudinal axis, the fold blade longitudinal axis, and the paper drive longitudinal axis are adjustable to achieve parallelism between the sheet trimmer, folding apparatus, and paper drive, and wherein at least two of the cutting blade, the fold blade, and the paper drive are pivotally attached to the booklet maker body by pivots having pivot axes which are parallel to one another.

7. The booklet maker of claim 1, comprising two adjustment screws for moving at least two of the cutting blade, the fold blade, and the paper drive, the adjustment screws each movable along an adjustment axis which is substantially perpendicular to the respective cutting blade longitudinal axis, fold blade longitudinal axis, or paper drive longitudinal axis.

8. The booklet maker of claim 1, wherein the sheet trimmer and folding apparatus trim and fold sheets one at a time.

9. The booklet maker of claim 1, comprising a collection and stapling apparatus for collecting the folded sheets in a stack and stapling the sheets to form a booklet.

10. A sheetwise booklet maker for trimming and folding individual sheets of material and binding the individual sheets together in a booklet, the booklet maker comprising:

trim means for trimming edges of individual sheets, the trim means having a longitudinal axis;

fold means for folding the individual sheets, the fold means having a longitudinal axis;

transport means for transporting the individual sheets to the trimming and folding means, the transport means having a longitudinal axis; and means to adjust orientations of the longitudinal axes of at least two of the trim means, fold means, and transport means to achieve parallelism between the trim means, fold means, and transport means.

11. The booklet maker of claim 10, comprising a booklet maker body, wherein the trim means, fold means, and transport means are mounted on the booklet maker body.

12. The booklet maker of claim 11, wherein the trim means is pivotally attached to the booklet maker body to allow adjustment of the orientation of the trim means longitudinal axis and a trim means lock is arranged to lock the trim means in a desired orientation on the booklet maker body.

13. The booklet maker of claim 11, wherein the fold means is pivotally attached to the booklet maker body to allow adjustment of the orientation of the fold means longitudinal axis and a fold means lock is arranged to lock the fold means in a desired orientation on the booklet maker body.

14. The booklet maker of claim 11, wherein the transport means is pivotally attached to the booklet maker body to allow adjustment of the orientation of the transport means longitudinal axis and a transport means lock is arranged to lock the transport means in a desired orientation on the booklet maker body.

15. The booklet maker of claim 11, wherein at least two of the trim means, the fold means, and the transport means are pivotally attached to the booklet maker body by pivots having pivot axes which are parallel to one another.

16. A method of manufacturing a booklet maker, the method comprising:

assembling a booklet maker including a sheet trimmer, a folding apparatus, and a paper drive positioned to transport individual sheets to the sheet trimmer and the folding apparatus;

adjusting orientations of longitudinal axes of at least two of the sheet trimmer, the folding apparatus, and the paper drive to achieve parallelism between the sheet trimmer, folding apparatus, and paper drive;

locking the at least two of the sheet trimmer, folding apparatus, and paper drive in a parallel arrangement; and determining final distances between the sheet trimmer and paper drive and between the paper drive and the folding apparatus, and inputting the distances into a processor of the booklet maker.

17. A method of manufacturing a booklet maker, the method comprising:

assembling a booklet maker including a sheet trimmer, a folding apparatus, and a paper drive positioned to transport individual sheets to the sheet trimmer and the folding apparatus;

adjusting orientations of longitudinal axes of at least two of the sheet trimmer, the folding apparatus, and the paper drive to achieve parallelism between the sheet trimmer, folding apparatus, and paper drive; and locking the at least two of the sheet trimmer, folding apparatus, and paper drive in a parallel arrangement, wherein the adjusting step is performed by rotating an adjustment screw to pivot the sheet trimmer, folding apparatus, or paper drive about a pivot.

18. The booklet maker of claim 2, wherein the adjusting mechanism includes a pivot to pivotally attach the cutting blade to the booklet maker body to allow adjustment of the orientation of the cutting blade longitudinal axis and a cutting blade lock arranged to lock the cutting blade in a desired orientation on the booklet maker body.

19. The booklet maker of claim 2, wherein the adjusting mechanism includes a pivot to pivotally attach the fold blade to the booklet maker body to allow adjustment of the orientation of the fold blade longitudinal axis and a fold blade lock arranged to lock the fold blade in a desired orientation on the booklet maker body.

20. The booklet maker of claim 2, wherein the adjusting mechanism includes a pivot to pivotally attach the paper drive to the booklet maker body to allow adjustment of the orientation of the paper drive longitudinal axis and a paper drive lock arranged to lock the paper drive in a desired orientation on the booklet maker body.

21. The booklet maker of claim 2, wherein the adjusting mechanism includes a plurality of pivots to pivotally attach at least two of the cutting blade, the fold blade, and the paper drive to the booklet maker body, the pivots having pivot axes which are parallel to one another.

* * * * *